US006702673B2

(12) United States Patent
Webb

(10) Patent No.: US 6,702,673 B2
(45) Date of Patent: Mar. 9, 2004

(54) FRACTIONAL PAYOFF AND COMPETITIVE WAGERING

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 57 days.

(21) Appl. No.: 09/961,312

(22) Filed: Sep. 25, 2001

(65) Prior Publication Data

US 2003/0060274 A1 Mar. 27, 2003

(51) Int. Cl.[7] ..... A63F 1/00

(52) U.S. Cl. ..... 463/25; 463/29; 463/27; 463/16; 463/31; 273/148 B

(58) Field of Search ..... 463/12, 42, 25–29, 463/40, 13; 705/10; 273/292, 274, 148 B

(56) References Cited

U.S. PATENT DOCUMENTS 5,277,424 A * 1/1994 Wilms ..... 463/12
5,476,259 A * 12/1995 Weingardt ..... 463/28
5,643,086 A * 7/1997 Alcorn et al. ..... 463/29
5,743,799 A * 4/1998 Houriet, Jr. et al. ..... 463/25
5,761,647 A * 6/1998 Boushy ..... 705/10
RE35,864 E * 7/1998 Weingardt ..... 463/28
5,800,268 A * 9/1998 Molnick ..... 463/40
6,106,396 A * 8/2000 Alcorn et al. ..... 463/29
6,182,968 B1 * 2/2001 Wilkinson ..... 273/292
6,264,560 B1 * 7/2001 Goldberg et al. ..... 463/42
6,540,230 B1 * 4/2003 Walker et al. ..... 273/292

* cited by examiner

*Primary Examiner*—Teresa Walberg
*Assistant Examiner*—Yveste G Cherubin
(74) *Attorney, Agent, or Firm*—Nixon & Vanderhye P.C.

(57) ABSTRACT

A method of enabling competitive wagering in a casino game provides a vehicle for a casino to offer payoff amounts for winning wagers in a casino game that are higher than conventional casino game payoff amounts while maintaining a satisfactory casino advantage. With this method, payoff amounts result in non-denominated fractional payouts, which can be processed according to a casino preference. In one embodiment, the non-denominated fractional payouts are accumulated during repeated game play and settled after game play is completed. Alternatively, rules can be established for rounding fractional amounts to a nearest denominated payout, converting the accumulated non-denominated fractional payouts into casino promotional awards, and the like. The methodology can be suited for any game format including casino table games, electronic games, internet casinos, etc.

24 Claims, 1 Drawing Sheet

FRACTIONAL PAYOFF AND COMPETITIVE WAGERING

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to wagering in casino games and, more particularly, to a method of enabling competitive wagering via fractional payouts in an internet casino environment or in a gaming machine environment.

In casino table games, the majority of payoffs on the conventional games such as Blackjack and Baccarat are at even money, which is commonly expressed as 1 to 1. Other games such as Craps and Roulette feature payoffs above even money as do many newer games such as Three Card Poker.

Nearly all of these payoffs are whole or denominated amounts rather than in non-denominated fractional amounts. The notable exceptions are the 3 to 2 payoff for Blackjack and certain payoffs at Craps. The casino operator will usually request wagers to be made in amounts that can easily be paid in whole amount payoffs. Odds of 6 to 5 could be paid on a $5 wager but could also be paid on a $1 wager where the operator uses 20 cent chips.

Odds of 6 to 5 could also be presented as odds of 1.2 to 1 and odds of 3 to 2 presented as 1.5 to 1. However, should a casino operator wish to offer slightly better odds than other operators do, then payoffs like 1.51 to 1 or other fractionally higher payoffs for a Blackjack are operationally impractical. This scenario would require keeping 1-cent coins in the chip tray. There is already limited room in the chip tray for different denominations. Also, the amount of extra time required to payoff the extra 1-cent per dollar would slow down the game. Any incremental benefit from an increase in play through the promotion of 1.51 odds would be negated by the reduction in game speed.

BRIEF SUMMARY OF THE INVENTION

Table games are now also played as both internet casino games and as machine games in physical casinos. A methodology of offering fractional payoffs or otherwise non-denominated fractional payoffs could be applied to these forms of casino gaming. The method could also be utilized with any form of casino gaming irrespective of whether the game is a table game or another form of game. Utilizing this methodology creates a unique opportunity for casinos to gain market share in these environments by offering more favorable payoffs than the general market.

Small denomination wagers are viable in an electronic environment so a wager as low as 1-cent may be acceptable. In this case, any payoff other than a whole number cannot be paid in immediate funds. By allowing fractional payoffs to be accumulated, however, whole payoffs can be paid. For example, 100 payoffs of 1.51 to 1 with 1-cent wagers creates a payoff total of $2.51 being $1.00 wagers returned and $1.51 winnings. Where wagers are in $1.00 amounts, the total payoff would be $251.00.

In either case, part payoffs could be credited toward future play. This could occur in a cash free machine environment where credit is given at the end of play of a machine by a printout which may be changed at the cash desk or credited to another game machine. In an internet casino, the credit funds may be automatically retained in the player name until withdrawal.

A further advantage of the fractional payoff methodology is to substitute for the current system of rewarding player participation. Currently, a casino may reward to a player at the end of a session of play an amount based on the theoretical house win. This may be in complementary promotional awards ("comps") or in cash. By paying more back in the base game, the reward may be eliminated. In this manner, a method of instant player rewards has been created.

In one arrangement, the cumulative fractional payoffs could be regarded as rewards only. For example, in the case of 100 winning wagers at 1.51 to 1 at $1.00 per wager, then the payoff is $250 and $1 is the reward. This is of course the same total payoff but allows retention of the $1 to enable an accumulative reward methodology. These rewards can be applied to casino promotions, just like regular rewards.

In an exemplary embodiment of the invention, a method of enabling competitive wagering in a casino game includes the steps of (a) setting a payoff amount for a winning wager in the casino game, the payoff amount resulting in non-denominated fractional payouts; (b) accumulating the non-denominated fractional payouts during repeated game play of the casino game; and (c) settling the accumulated non-denominated fractional payouts after the repeated game play is completed. Step (c) may be practiced by paying out the accumulated non-denominated fractional payouts rounded to a nearest denominated payout. Alternatively, step (c) may be practiced by converting the accumulated non-denominated fractional payouts into casino promotional awards. In one embodiment, the casino game includes a plurality of linked casino games in an electronic format, wherein step (b) is practiced by accumulating the non-denominated fractional payouts during repeated play of the plurality of linked casino games. In this context, the electronic format may be a casino game machine, computer software, an internet casino or the like.

Step (c) may still alternatively be practiced by enabling the accumulated non-denominated fractional payouts to be transferred for subsequent play at, at least one of, a later time or another casino game. In this context, step (c) is practiced by generating a printed credit ticket or by recording credits accumulated for internet play or the like.

In one operating mode, the casino game is Blackjack, and step (a) is practiced by setting the payoff amount for a two-card total of twenty-one to be greater than or equal to 1.51 to 1.

In another exemplary embodiment of the invention, a method of enabling competitive wagering in a casino game includes the steps of providing a vehicle for a casino to offer payoff amounts for winning wagers in a casino game that are higher than conventional casino game payoff amounts while maintaining a satisfactory casino advantage, wherein the payoff amounts result in non-denominated fractional payouts, and processing the non-denominated fractional payouts according to a casino preference. In this context, the processing step may include the steps of accumulating the non-denominated fractional payouts during repeated game play of the casino game, and settling the accumulated non-denominated fractional payouts after the repeated game play is completed.

In other exemplary embodiments of the invention, a computer program embodied on a computer-readable medium and a casino game system are provided for enabling competitive wagering in a casino game according to the present invention.

BRIEF DESCRIPTION OF THE DRAWINGS

These and other aspects and advantages of the present invention will be described in detail with reference to the accompanying drawings, wherein the FIG. 1 is a flow diagram showing the method and system according to the present invention.

DETAILED DESCRIPTION OF THE INVENTION

Figure 1:
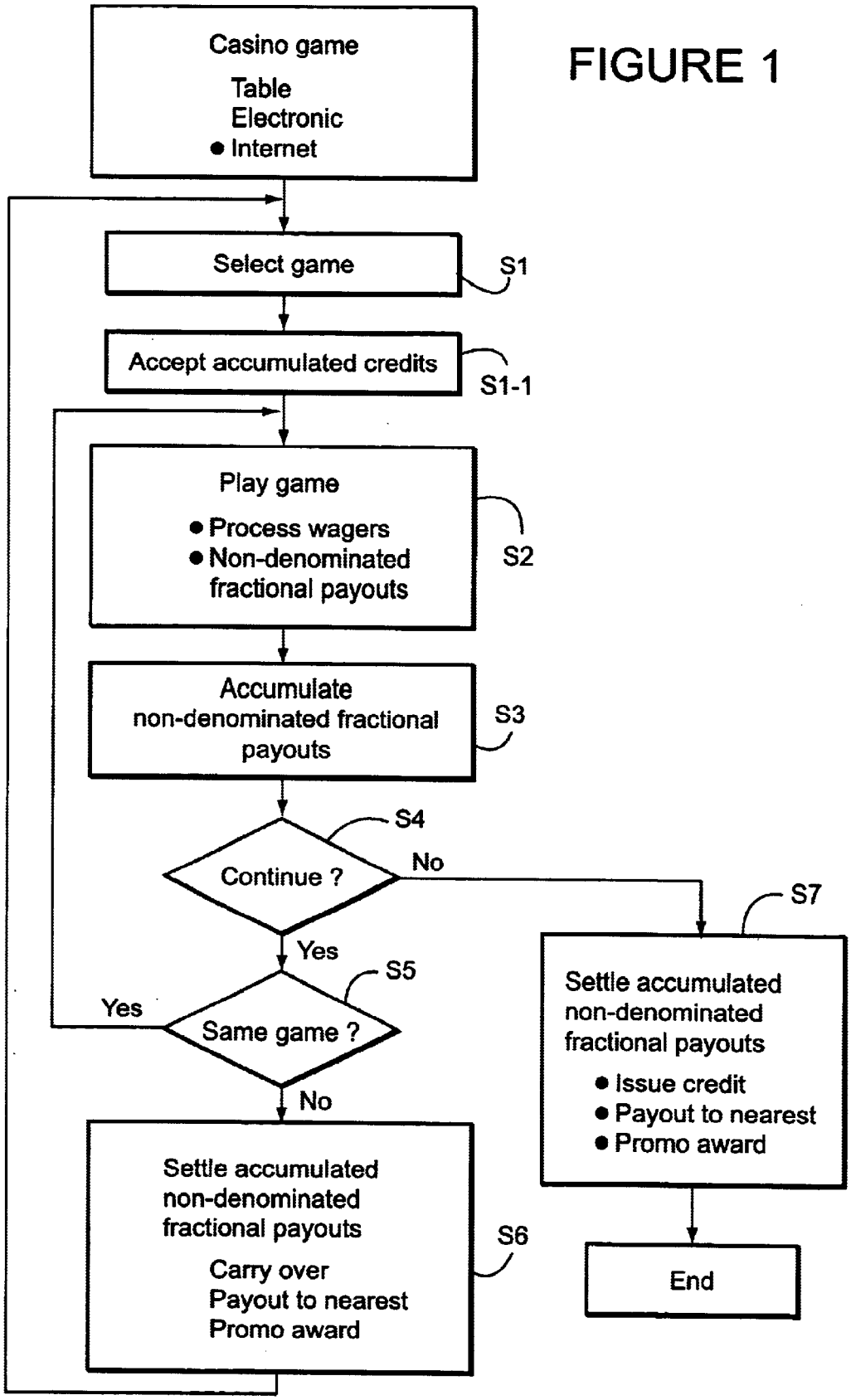

According to the present invention, a method is provided that enables competitive wagering in a casino game, particularly in an electronic casino game or internet casino game. The method serves as a vehicle for a casino to offer payoff amounts for winning wagers in the casino games that are higher than conventional casino game payoff amounts while maintaining a satisfactory casino advantage. In this context, the higher payoff amounts result in non-denominated fractional payouts that can be processed in several ways according to casino preference.

The phrase "non-denominated fractional payout" in the context of the present invention encompasses any payout that is smaller than the smallest game payout denomination. For example, in a game environment where the smallest payout or smallest game payout denomination is one dollar ($1), a non-denominated fractional payout is anything less than one dollar (<$1). Similarly, if the smallest game payout denomination is one cent ($0.01) or one hundred dollars ($100), a non-denominated fractional payout is anything less than one cent (<$0.01) or less than one hundred dollars (<$100), respectively. Assume that a dealer's chip tray has a collection of chips, thereby defining "denominated" payouts, the dealer would be unable to payout anything less than the smallest denominated chip in the tray. These amounts less than that smallest amount are considered non-denominated fractional payouts according to the present invention. Of course, in an electronic or internet game format, there is no "chip tray" per se. In this context, however, the smallest game payout denomination can be designated according to game rules, such as $100 or $10 or $1, etc., and a non-denominated fractional payout is any smaller amount than the smallest game payout denomination, such that the non-denominated fractional payout is a fraction of the smallest game payout denomination.

The fractional payout methodology according to the present invention will be described in the context of an electronic casino game or internet casino game, but the methodology is readily applicable to conventional table games as would be apparent to those of ordinary skill in the art. Generally, the electronic and/or internet game is driven by computer software.

With reference to the FIG. 1, one or more casino games can be embodied in a single application in either an electronic game format or internet format, where the player is provided with an opening screen providing an option to select a game for play (S1). Once selected, the system can be configured to prompt the player to accept carried-over credits for play (S1-1) via previous play, stored accumulations via a machine-readable ticket, stored accumulations via a user identification code, or the like, as discussed in more detail below.

Once selected, the game is played according to its rules and based on wagers placed by the player (S2). According to the method of the present invention, payouts for game wagers can be set fractionally higher than conventional payouts, providing the casino with a competitive advantage over other casinos offering the same games. For example, in a conventional Blackjack game, a payoff amount for a player two-card total of twenty-one is 3 to 2, which can be equivalently expressed as 1.5 to 1. Thus, a wager of $10 is paid $15 for a player's two-card hand totaling twenty-one. By the principles of the present invention, the casino can increase the payoff amount for a player two-card total of twenty-one to something fractionally higher than 1.5 to 1, such as, for example, 1.51 to 1 or higher. As a consequence to the increased payoff amounts, however, the player may be awarded non-denominated fractional payouts, which accumulate during play (S3). For example, in the Blackjack example discussed above, a payoff amount for a $10 wager on a player two-card total of twenty-one is $15.10.

When the game is complete, the system queries whether the player would like to play again (S4), and if so (YES in step S4), the system determines whether the player would like to play the same game (S5). If YES in step S5, the process returns to step S2 for further play (and further accumulation of non-denominated fractional payouts). If the player would like to continue (YES in step S4) but with a different game (NO in step S5) or if the player elects not to continue (NO in step S4), the accumulated non-denominated fractional payouts are settled (S6, S7, respectively) according to predetermined casino preferences (discussed in more detail below). After step S6, the process returns to step S1, and after step S7, the process ends.

In the method of the present invention, non-denominated fractional payouts can be settled in several ways. In one embodiment, as the non-denominated fractional payouts accumulate, the amounts may be consolidated into denominated payouts, with or without some fractional remainder, which are paid out to the player. The system may round remainders up or down or either to the nearest denominated payout. Alternatively, the non-denominated fractional payouts may be carried over for subsequent play. In this context, in an electronic game environment, the accumulated fractional payouts can be associated with the current player, such that as play continues with the one or more available games, the non-denominated fractional payouts continue to accumulate. To enable the current player to return at a later time with accumulated fractional payouts, the player may be provided with a printed credit slip or the like, which may or may not include some machine-readable code, for later insertion into the machine or other processing by the casino cash desk. In an internet environment, a "registered" player is typically associated with a running balance, which can readily incorporate accumulated fractional payouts. In this context, the accumulated fractional amounts may be accessed via a user login or the like through a casino web page. In yet another embodiment, the accumulated fractional amounts can be settled with casino promotional awards such as complimentary meals or accommodations or the like. The promotional awards can be valued dollar for dollar or at some increased multiple of the accumulated fractional amounts.

Of course, those of ordinary skill in the art will appreciate numerous variations for processing the accumulated fractional amounts, and the invention is not necessarily meant to be limited to one or more of the variations discussed above.

With the method and system according to the present invention, a casino can be provided with a vehicle to provide increased payouts in conventional or other casino games without significantly reducing a casino advantage. The non-denominated fractional amounts resulting from fractionally increased payouts can be settled in numerous ways according to casino preference.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of enabling competitive wagering in a casino game, the method comprising:

(a) setting a payoff amount for a winning wager in the casino game, the payoff amount resulting in non-denominated fractional payouts;

(b) accumulating the non-denominated fractional payouts during repeated game play of the casino game; and (c) settling the accumulated non-denominated fractional payouts after the repeated game play is completed.

2. A method according to claim 1, wherein step (c) is practiced by paying out the accumulated non-denominated fractional payouts rounded to a nearest denominated payout.

3. A method according to claim 1, wherein step (c) is practiced by converting the accumulated non-denominated fractional payouts into casino promotional awards.

4. A method according to claim 1, wherein the casino game comprises a plurality of linked casino games in an electronic format, and wherein step (b) is practiced by accumulating the non-denominated fractional payouts during repeated play of the plurality of linked casino games.

5. A method according to claim 4, wherein the electronic format is a casino game machine.

6. A method according to claim 4, wherein the electronic format is computer software.

7. A method according to claim 4, wherein the electronic format is an internet casino.

8. A method according to claim 1, wherein step (c) is practiced by enabling the accumulated non-denominated fractional payouts to be transferred for subsequent play at, at least one of, a later time or another casino game.

9. A method according to claim 8, wherein step (c) is practiced by generating a printed credit ticket.

10. A method according to claim 1, wherein step (c) is practiced by enabling the accumulated non-denominated fractional payouts to be recorded for subsequent play at, at least one of, a later time or another casino game.

11. A method according to claim 1, wherein the casino game is Blackjack, and wherein step (a) is practiced by setting the payoff amount for a two-card total of twenty-one to be greater than or equal to 1.51 to 1.

12. A method of enabling competitive wagering in a casino game, the method comprising providing a vehicle for a casino to offer payoff amounts for winning wagers in a casino game that are higher than conventional casino game payoff amounts while maintaining a satisfactory casino advantage, the payoff amounts resulting in non-denominated fractional payouts, and processing the non-denominated fractional payouts according to a casino preference.

13. A method according to claim 12, wherein the processing step comprises the steps of accumulating the non-denominated fractional payouts during repeated game play of the casino game, and settling the accumulated non-denominated fractional payouts after the repeated game play is completed.

14. A method according to claim 13, wherein the settling step is practiced by enabling the accumulated non-denominated fractional payouts to be transferred for subsequent play at, at least one of, a later time or another casino game.

15. A method according to claim 14, wherein the settling step is practiced by generating a printed credit ticket.

16. A method according to claim 13, wherein the settling step is practiced by paying out the accumulated non-denominated fractional payouts rounded to a nearest denominated payout.

17. A method according to claim 13, wherein the settling step is practiced by converting the accumulated non-denominated fractional payouts into casino promotional awards.

18. A method according to claim 13, wherein the casino game comprises a plurality of linked casino games in an electronic format, and wherein the accumulating step is practiced by accumulating the non-denominated fractional payouts during repeated play of the plurality of linked casino games.

19. A method according to claim 18, wherein the electronic format is a casino game machine.

20. A method according to claim 18, wherein the electronic format is computer software.

21. A method according to claim 18, wherein the electronic format is an internet casino.

22. A method according to claim 12, wherein the casino game is Blackjack, and wherein the payoff amount for a two-card total of twenty-one is set to be greater than or equal to 1.51 to 1.

23. A computer program embodied on a computer-readable medium enabling competitive wagering in a casino game, the computer program comprising:

means for setting a payoff amount for a winning wager in the casino game, the payoff amount resulting in non-denominated fractional payouts;

means for accumulating the non-denominated fractional payouts during repeated game play of the casino game; and means for settling the accumulated non-denominated fractional payouts after the repeated game play is completed.

24. A casino game system enabling competitive wagering in a casino game, the casino game system comprising:

means for setting a payoff amount for a winning wager in the casino game, the payoff amount resulting in non-denominated fractional payouts;

means for accumulating the non-denominated fractional payouts during repeated game play of the casino game; and means for settling the accumulated non-denominated fractional payouts after the repeated game play is completed.

* * * * *